United States Patent [19]

Dismukes

[11] 4,406,332

[45] Sep. 27, 1983

[54] ROTARY EARTH BORING TOOL

[76] Inventor: Newton B. Dismukes, 2952 Buttonwood Dr., Carrollton, Tex. 75006

[21] Appl. No.: 207,798

[22] Filed: Nov. 17, 1980

Related U.S. Application Data

[63] Continuation-in-part of Ser. No. 948,081, Oct. 2, 1978.

[51] Int. Cl.[3] ..... E21B 4/00

[52] U.S. Cl. ..... 175/107; 175/94; 173/159; 15/104.12; 415/502

[58] Field of Search ..... 175/107, 94, 97, 320, 175/325, 409, 67; 173/159; 15/104.06 R, 104.12; 415/502, 503; 416/20; 166/222

[56] References Cited

U.S. PATENT DOCUMENTS

| | | | |
|---|---|---|---|
| 79,695 | 7/1868 | Spaulding | 416/20 |
| 2,251,916 | 8/1941 | Cross | 175/67 X |
| 3,047,079 | 7/1962 | Wepsala | 175/107 |
| 3,372,763 | 3/1968 | Fischer | 175/409 X |
| 3,786,875 | 1/1974 | Merle | 173/159 |
| 4,050,849 | 9/1977 | Sheets | 416/20 X |
| 4,185,704 | 1/1980 | Nixon | 175/76 |
| 4,319,649 | 3/1982 | Jetter | 175/61 X |

OTHER PUBLICATIONS

Boice et al., The Design and Performance Characteristics of Aluminum Drill Pipe, JPT Dec. 1968, pp. 1285–1291.

*Primary Examiner*—Ernest R. Purser
*Assistant Examiner*—Thuy M. Bui
*Attorney, Agent, or Firm*—Sidney A. Johnson

[57] ABSTRACT

The present invention provides a nonstalling system for advancing a boring tool in situations where the inclination of the bore hole with respect to the vertical is such that the force of gravity does not provide effective forward thrust. A hydraulically powered marine screw propeller adjacent the boring tool provides the necessary thrust for the drilling operation. Pressurized drilling fluid provides the required hydraulic energy. The characteristics of the marine screw propeller are such that it provides maximum thrust at maximum rotative speed but should the tool stall the forward thrust drops to zero preventing stalling.

14 Claims, 9 Drawing Figures

ROTARY EARTH BORING TOOL

RELATED APPLICATIONS

This application is a continuation-in-part of application Ser. No. 948,081, filed Oct. 2, 1978.

BACKGROUND OF THE INVENTION

1. Field of the Invention

The present invention relates to the provision of a system for providing forward thrust for a boring tool. More particularly, the invention provides the necessary thrust for the operation of a rotary boring tool in situations, such as the drilling of generally horizontal bore holes, where the force of gravity does not act to provide effective forward thrust. The invention is especially efficacious with flexible drill pipe or conduit such as may be used in drilling highly deviated bore holes.

2. Description of the Prior Art

Hydraulic power has been used to rotate boring tool in drilling vertical and deviated bore holes for many years. Typical of such tools is the Dyna-Drill, offered by the Dyna-Drill Company, a division of Smith International, Inc. of Irvine, California. The power generated by the Dyna-Drill is used and only used to rotate the drilling bit. The system is used with conventional drill pipe and drill collars to provide the desired weight on bit or thrust.

A. McDougall, U.S. Pat. No. 469,841 discloses a system for dredging in which a boring tool is mounted on the same shaft as a propeller. Flow of liquid circulated for the dredging operation causes both to rotate. Thrust for the boring tool, however, is obtained by the weight of the system. The reverse circulation system disclosed actually tends to lift McDougall's boring tool rather than to advance it.

A water jet propelled nozzle head for cleaning pipes and conduits is disclosed by U.S. Pat. No. 2,710,980 to Pletcher in which jets direct water against vanes to rotate an outer section relative to an inner section which is fixedly secured to a hose. Neither the rotative nor the advancing force developed is adequate for subsurface earth boring.

Kirschke, U.S. Pat. No. 3,432,872, shows a jet propelled hydraulic pipeline cleaner having a vaned rotor and radial and tangential jets. The device is cumbersome and is not suited to earth boring.

Masters, U.S. Pat. No. 3,525,112, proposes a rotary root cutting head for use in sewer pipe having rearwardly facing nozzles to impell the head forwardly and tangential nozzles in a rotor. The system is not serviceable in underground boring due to lack of sufficient advancing and rotative force and because of its structural configuration.

Elbert, U.S. Pat. No. 3,844,362, discloses a boring device which utilizes ejected fluid to provide rotative torque and to assist in driving the device forward. The advancing force developed is clearly insufficient to cut into an earth formation and also tug a hose into a lateral passageway of useful length.

More generally, the prior art is rich in the field of drilling directionally deviated wells using rotary bits turned from the surface or by subsurface mud turbines. However, such boring means are not self-advancing in generally horizontal bore holes, do not have non-stalling characteristics and are unable to form sharply curved bores, all of which constitute advantages of the instant invention.

SUMMARY OF THE INVENTION

The instant invention utilizes the principles of a marine screw propeller to derive the necessary thrust forces for the operation of an earth boring tool. The marine screw propeller is normally used to develop the thrust needed to move a vessel through water. According to "Principles of Naval Architecture", Volumn II, edited by Rossell and Chapman and published by the Society of Naval Architects and Marine Engineers, "propellers derive their propulsive thrust by accelerating the fluid in which they work". The term "marine screw propeller" as used herein includes any rotating device which develops thrust parallel to the axis of rotation by accelerating the fluid in which it works.

Thrust derived from a marine screw propeller in accordance with my invention provides the 'weight on the bit' necessary for earth boring. This thrust also may provide the force required to advance a shaft, preferably neutrally buoyant in the drilling fluid, through which energy needed for the boring operation is supplied.

In accordance with my invention the shaft upon which the propeller is mounted is caused to rotate by hydraulic force derived from the circulating drilling mud. Either a mud motor, such as the Dyna-Drill, may be used or a portion of the circulating drilling fluid may be discharged through jet nozzles near the propeller blade tips to provide rotative torque through the reactive force of the fluid ejected at high velocity.

Speed of rotation is related to several factors including viscosity and density of the drilling fluid, propeller diameter, the drag forces due to cutting element contact with the earth, and to fluid friction. One of the differences between the instant invention and ordinary marine propeller operation is that fluid access to the forward face of a propeller blade bit is restricted by blade rotation and space considerations. Therefore, fluid pressure difference between the forward and aft faces of the propeller blade is greater than in unshrouded marine applications. Selection of propeller pitch and/or use of asymmetric foil shaped blades permit a wide range of thrust forces for a given rate of rotation. Cavitation is not a problem because of the great submergence of the device in a boring operation.

The propeller bit inherently possesses highly favorable drilling characteristics. It tends to be non-stalling because it develops no thrust at zero revolutions per minute. It is highly efficient because it develops maximum thrust at maximum rotative speed. The inherent characteristics are improved by judicious selection of propeller blade pitch, degree of asymmetry in the foil shaped blade and of amount of torque developed. The result is a highly efficient boring tool which automatically adjusts thrust and rotary speed to maintain continuous, effective penetration.

The propeller bit contains at least one forwardly facing water course to assist in removing cuttings from the newly formed bore hole. The cross-sectional area of the water course is designed to be large enough to clean the hole but not so great as to inhibit bit advance. However, the reaction force of the ejected fluid is great enough to push the bit backward if rotation, and hence thrust, ceases and thus does contribute to the non-stalling character of the bit.

Since the drilling system of my invention is primarily intended for use in drilling substantially horizontal bore holes, the drilling fluid conduit is preferably designed to be neutrally buoyant in the drilling mud used to reduce frictional drag between the exterior of the conduit and the bore hole wall. The use of such a neutrally buoyant drilling system is taught and claimed in my copending application Ser. No. 06/125,240, filed Feb. 27, 1980. This absence of drag combined with the exceptional boring efficiency permits the formation of long passageways. The term "neutrally buoyant" as used herein means that the density of a mass immersed in the drilling fluid is from 70 to 130 percent of the density of the fluid.

DESCRIPTION OF PREFERRED EMBODIMENTS

Figure 1:
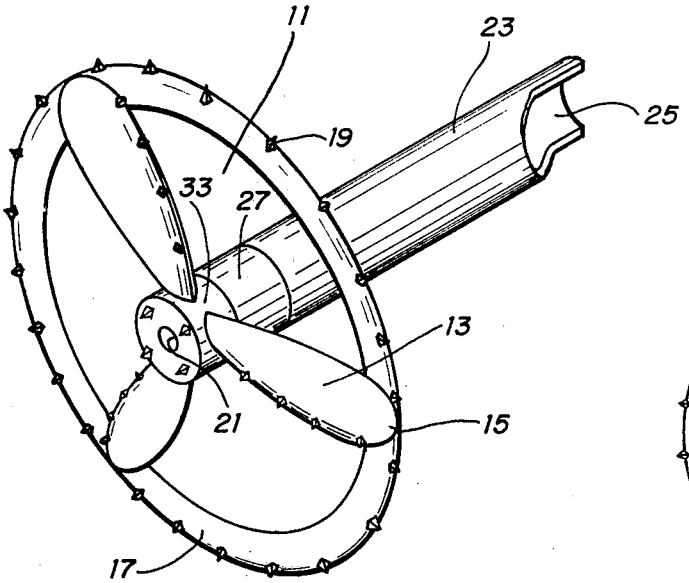
FIG. 1 is a view, partly in cross-section and partly schematic, of a combination propeller bit form of the invention.
Figure 2:
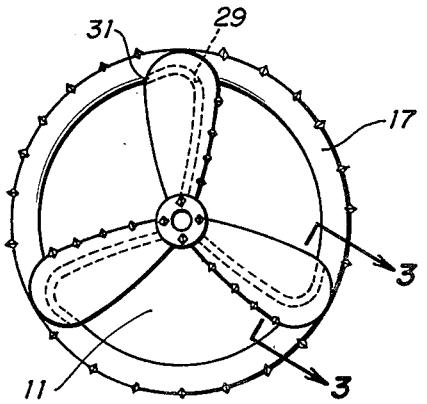
FIG. 2 is a frontal view of the propeller bit of FIG. 1 showing the fluid conduits and jet nozzle carried by the propeller blades in phantom.
Figure 3:
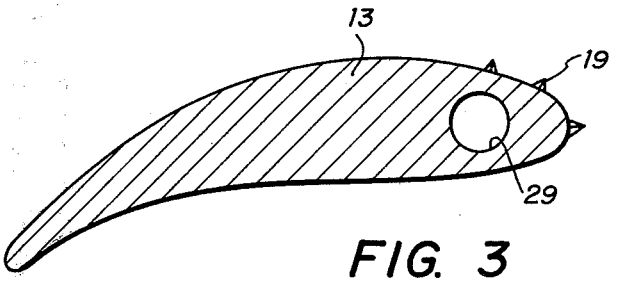
FIG. 3 is an enlarged cross-sectional view of a propeller blade taken on the line 3—3 of FIG. 2.

One form of hydraulically advanced and rotated boring tool indicated in general by the numeral 11 is shown in FIG. 1. The tool has the general shape of a multi-bladed marine screw propeller. Blades 13 and blade tips 15 are connected by a circular tubular ring 17. Blades and ring are fitted with hardened cutting elements 19 as is the surface around water course 21. Blades 13 may have the usual marine propeller configuration or may be formed into an asymmetrical hydrofoil shape as indicated in FIG. 3, which increases lift/drag ratio. Drilling fluid passes through hollow conduit shaft 23 having fluid passage 25 and through rotary union 27 to propeller shaft to which blades 13 are fixed, thence into passage 29, FIG. 2, to be ejected tangentially at high velocity through jet nozzle 31 to impart rotational force to propeller bit 11. Ejected fluid is prevented from impinging upon, and possibly damaging, ring 17 by angling jet nozzles 31 slightly toward the rear or by making appropriate notches in ring 17.

Figure 4:
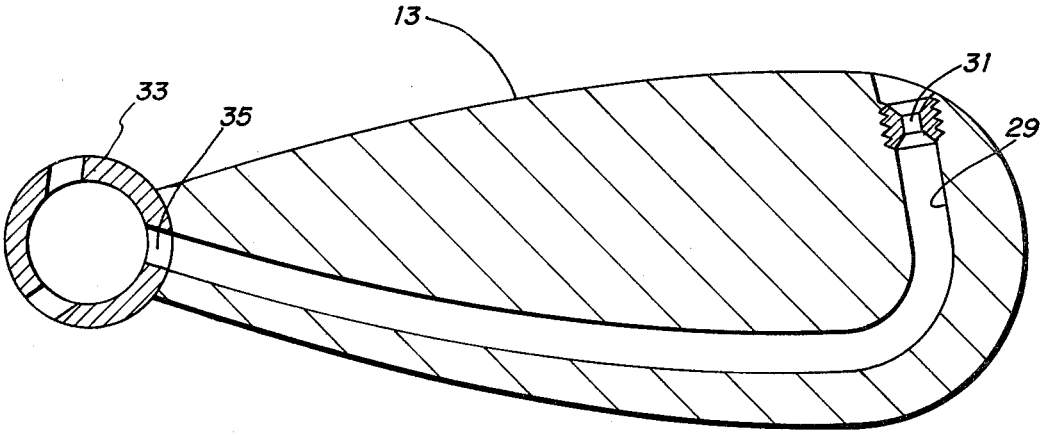
FIG. 4 is an enlarged view of the fluid conduit in a propeller blade in cross-section showing the jet nozzle and the fluid inlet port in the wall of the hollow shaft on which the propeller blade is mounted.

FIG. 4 shows a cross-section of a fluid passage 29 contained in a hydrofoil shaped propeller blade 13, shown in cross-section in FIG. 3. Nozzle 31 is replaceable as is common practice in oil well drilling. The propeller blade 13 is fastened to propeller shaft 33, which, as described above, is connected to the conduit shaft 23 by rotary union 27, permitting relative rotation therebetween. Drilling fluid flowing through passage 25 into the hollow propeller shaft flows in part through ports 35 into the fluid passages 29 and exits as a jet stream through nozzles 31. The remaining portion of the drilling fluid exits through water course 21 where it functions to lubricate the cutting elements and wash away the cuttings.

Figure 5:
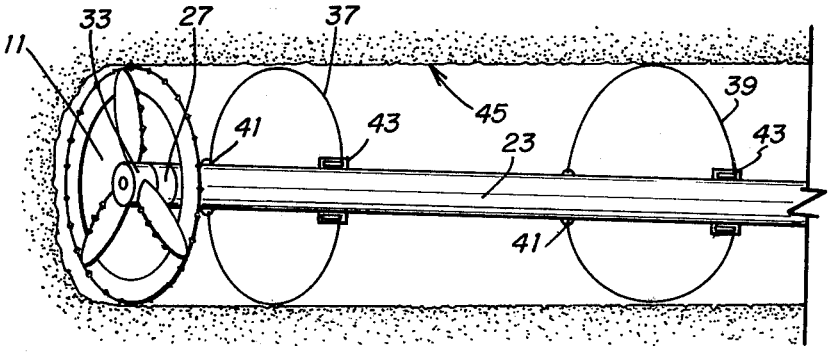
FIG. 5 shows a modification of the propeller bit with the addition of directional guidance means.

The effect of gravity on a dense boring tool is to cause a downwardly trending borehole instead of a horizontal borehole. One way to overcome the downwardly trending path involves the use of centralizers 37 and 39 mounted on conduit shaft 23 as shown in FIG. 5. The centralizers may be made from a highly elastic material such as spring steel or a fiber reinforced plastic. The foward end of the centralizer springs is fixed to conduit shaft 23 while the after end is mounted in a slot 43 which permits axial movement to accommodate hole irregularities. A plurality of such centralizing springs is used to make up the forward and the after sets, perhaps 6 or 8 in each set. As shown in FIG. 5, the forward centralizer 37 maintains conduit shaft 23 in the central portion of the borehole while the after centralizer is so constructed and mounted on conduit shaft 23 as to maintain shaft 23 closer to one side of the borehole 45, as shown closer to the lower side. This causes tool 11 to attack the earth material being drilled in a slightly upward direction which counteracts the tendency of the dense tool to progress downwardly due to the force of gravity. A borehole survey tool may be inserted into the portion of shaft 23 between the two centralizer sets to reveal the direction and angle of progress. By twisting shaft 23 the 'low side' of the centralizer set 39 may be caused to approach any other side of the borehole and thus act to guide the path of drilling in any desired direction.

Figure 6:
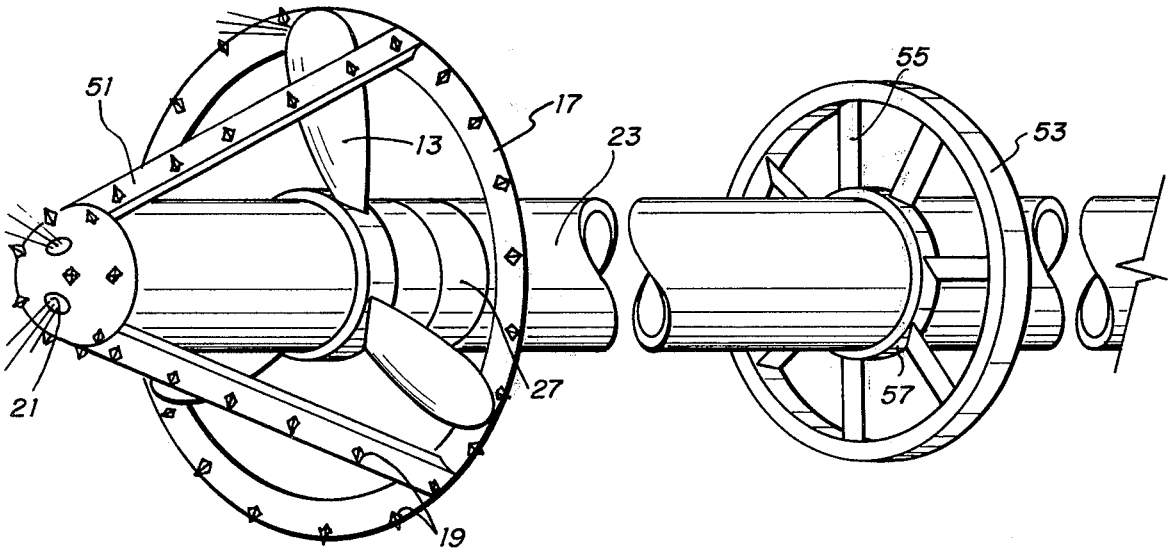
FIG. 6 shows a modified form of propeller bit including an alternative form of means for directional guidance.

Another embodiment of the propeller bit is shown in FIG. 6. It is similar to the tool shown in FIG. 1 except that a plurality of lengthened water courses 21 are provided together with cutting struts 51 spaced to support additional cutting elements 19. This embodiment forms a bore hole having a conical outer end. The tool shown in FIG. 6 employs another means to control the direction of advance of the boring tool and to overcome the tendency of the tool to form a downwardly inclining lateral bore hole. A weight shaped in the form of a rim 53 of a wheel having spokes 55 attached to hub 57 is rotatably mounted on shaft 23 as indicated in FIG. 6. Rim weight 53 has a smaller diameter than ring 17 and is mounted sufficiently to the rear of tool 11 to cause the tool to point upwardly from the horizontal to form an upwardly inclining bore hole.

It should be understood that a horizontal bore hole may be caused to rise by increasing the angle of the axis of rotation of a propeller bit to above 90 degrees as may be accomplished by decreasing the diameter of rim weight 53, by increasing its weight, by shortening the distance between rim 53 and tool 11 or by a combination of these steps.

A negatively buoyant propeller bit 11 with right hand rotation usually will walk toward the right to drill a curved lateral bore. Conversely, left hand rotation yields a bore hole curving to the left. By running tools having alternately right hand and left hand rotation, a lateral bore may be formed which curves toward the right and then toward the left but eventually winds up as an essentially straight passageway.

The propeller bit illustrated in FIG. 6 may be constructed from any convenient material. For example, blades 13, ring 17 and struts 51 may be of alloy steel while cutting elements 19 and water courses 21 may be made of a hardened material such as one of the carbides. Rotary union 27 may be an off-the-shelf item supplied by Deublin Company of Northbrook, Illinois. Propeller bit 11 should be carefully assembled and sturdily built to withstand rough usage. Of course, it need not be as strongly built as a rock bit because the forces involved are not as great as in deep oil well drilling.

Figure 7:
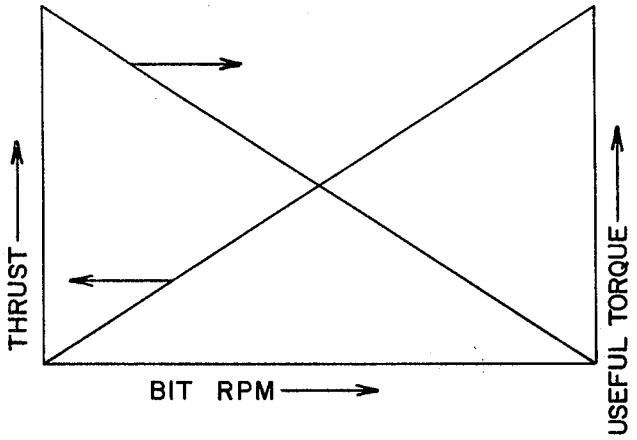
FIG. 7 is a graphic illustration of the relationship between the speed of rotation of the propeller and the delivered thrust and useful torque.

FIG. 7 illustrates the relationship between tool RPM, useful torque and thrust. At zero RPM thrust is nil and torque is a maximum. Thrust increases with increasing rate of rotation, while torque available to the bit decreases. The speed of rotation and hence the delivered thrust and torque for any given tool will be dependent upon the raate of flow of the drilling fluid through a mud powered motor rotating a shaft upon which are mounted propeller blades or through the propeller jet discharge nozzles. Such factors as the density and viscosity of the drilling fluid and the nature of the formation being drilled will affect the speed of rotation and hence, the balance between torque and thrust delivered by a rotating marine screw propeller. This ability to automatically adjust the balance between thrust and torque represents an important and significant benefit of the present invention. When the amount of torque required to rotate the bit increases, the bit slows down, and the thrust delivered by the propeller decreases, slowing the rate of penetration until the system comes into balance. Conversely, when the torque required diminishes, the resultant decrease in rotational load allows the bit and propeller to speed up increasing the thrust and the rate of drilling, again until the system comes into balance. Also, and importantly, should the bit tend to stall, as, for example, caused by suddenly entering a difficult to drill formation, the concurrent slowing of the propeller would rapidly reduce the thrust to or substantially to zero allowing the reactive forces generated by the water courses in the drill bit to retract the bit. In such event the form of invention where the shaft rearward of the bit is splined as shown in FIG. 8 is especially advantageous, since the bit may readily retract without having to overcome any inertia from the mud motor or the flexible conduit.

Figure 8:
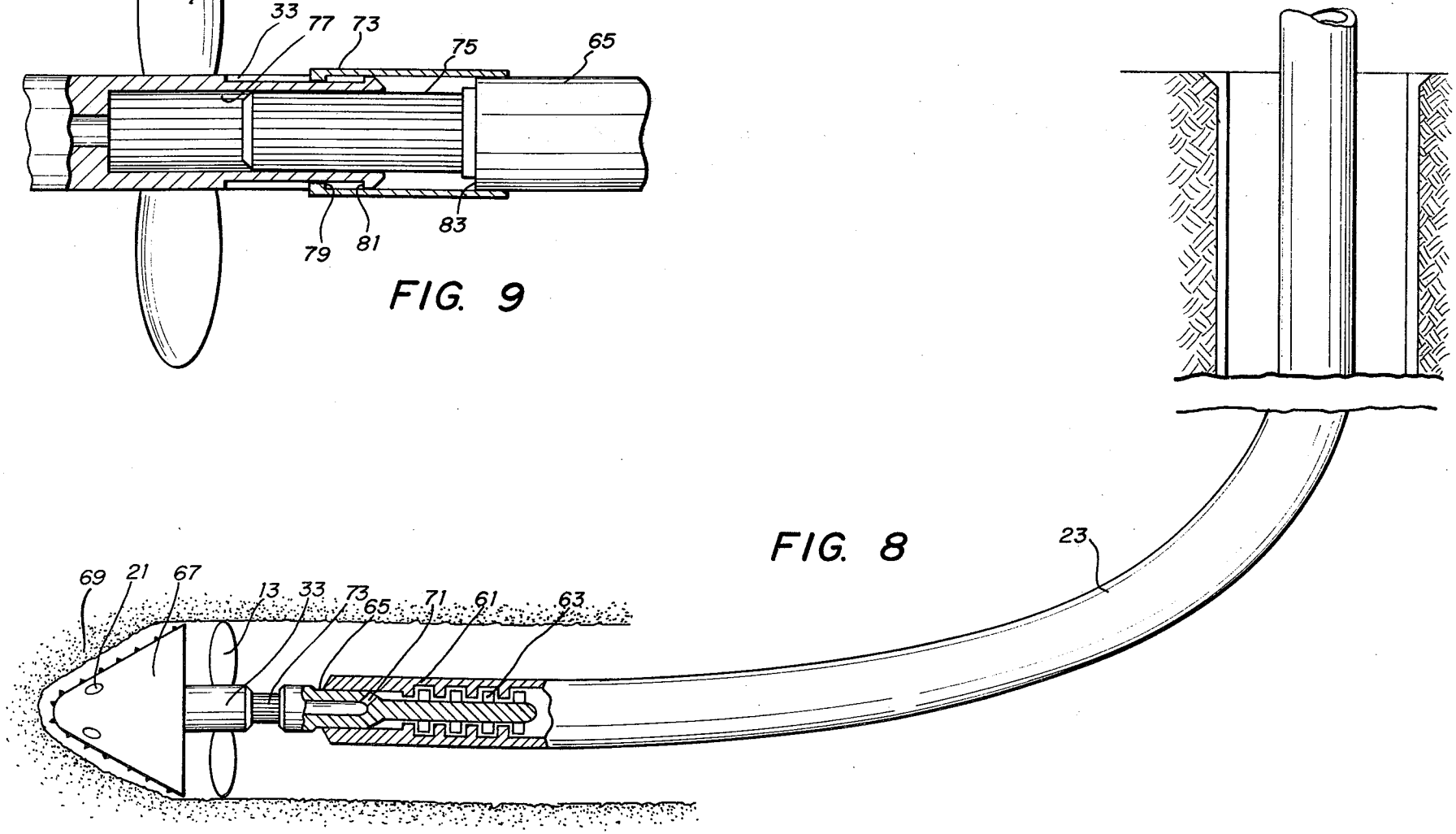
FIG. 8 shows another form of propeller bit, partly in cross-section and partly schematic, in position for drilling a horizontally deviated well bore with separate means for rotating the propeller and drilling bit.
Figure 9:
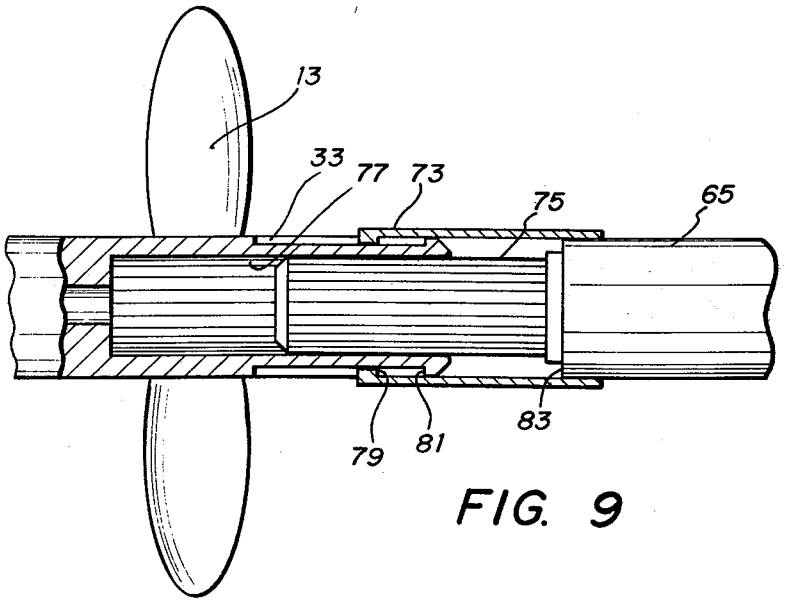
FIG. 9 shows the details of the spline connection shown in FIG. 8 linking the propeller shaft and the motor shaft.

In the form of my invention shown in FIG. 8 the rotative force for propeller blades 13 is derived from a hydraulically powered motor 61. Flow of pressurized drilling fluid from conduit shaft 23 through hydraulic turbine motor 61 causes the turbine blades 63 and power shaft 65 to rotate, rotating the propeller blades and drilling bit 67. Suitable hydraulic turbodrill motors are manufactured and marketed by Neyrfor Alsthom-Atlantique, Grenoble, France. Thrust generated by the propeller forces the bit against formation 69 extending the well bore. Drilling fluid exits the turbine through port 71 in the turbine shaft whence it flows forward through the turbine and propeller shaft and exits through water courses 21 in the bit. Desirably, the propeller shaft 33 and power shaft 65 are joined by a splined connection 73, shown in detail in FIG. 9. The male spline 75 at the end of shaft 65 mates with the female splined grooves 77 in the rear end of propeller shaft 33. Stop 79 at the forward end of the turbine shaft will engage stop 81 on the aft end of the propeller shaft holding the spline connection together as the propeller advances. Should the bit 67 and propeller 13 stall, drilling fluid jetted from the forward facing water courses 21 will drive the bit and propeller back until the rear side of stop 81 rests against stop 83. Sufficient retraction of the bit to allow it to resume rotation will thus be obtained without requiring the backing up of the entire system.

As stated above, one way to overcome a downward trend of a well bore being drilled with the drilling system of the present invention is to employ a tool and fluid conduit neutrally buoyant in the drilling fluid. For use in a 10 pounds per gallon drilling fluid boring tool 11 may be cast from a mix comprised of cycloaliphatic epoxy 61 parts, ceramic microballoons 31 parts and glass fibers 5 parts by volume with steel trim, additional epoxy cement and tungsten carbide or other hard material comprising the remaining 3 parts by volume. Ring 17 is essentially neutrally buoyant when made from a length of aluminum tubing hermetically sealed against fluid entry. For example, a one-inch outside diameter, round, aluminum tubing, closed at the ends, weighing 0.28 pounds per foot would have a density of 0.83 grams per milliliter. A 1.5-inch tube weighing 0.635 pounds per foot would have the same density. Such tubular rings may be roughened and coated with an epoxy with a hard surface material added to form a cutting element 19. Other cutting elements 19 are set into small diameter holes bored into the epoxy casting after it has hardened using an epoxy cement. Such neutrally buoyant tools tend to be fragile and mainly are suited to boring soft, shallow strata.

A suitable, low density drilling fluid shaft conduit may be formed from a glass reinforced polyethylene plastic, having, for example, a density of 1.20 grams per milliliter, a tensile modulus of 25,000 pounds per square inch and a tensile strength, determined in burst, of 3,600 pounds per square inch.

Since many modifications and possible embodiments and uses may be made of the apparatus of this invention without departing from the scope thereof, it is to be understood that all matter herein set forth or shown is to be interpreted as illustrative not as limiting.

What is claimed is:

1. A rotary drilling tool comprising in combination:

a. a hollow shaft;

b. a marine screw propeller comprising a plurality of propeller blades affixed to said shaft in a manner such that rotation of said propeller generates thrust along the axis of said shaft;

c. drilling bit means fixed to the forward end of said shaft, said bit means having an external diameter at least as great as the diameter of said propeller;

d. fluid discharge nozzle means positioned on at least one blade of said propeller in a manner such that discharge of fluid therefrom will exert a force in a direction tending to cause said propeller to rotate;

e. fluid passage means carried by said at least one propeller blade adapted to conduct fluid from the interior of said hollow shaft to said discharge nozzle;

f. conduit means for conducting fluid to said rotary drilling tool; and g. bearing means connecting said hollow shaft and said conduit to permit relative rotation therebetween.

2. The drilling tool according to claim 1 wherein the marine propeller blades have an asymmetric hydrofoil shape.

3. The drilling tool according to claim 1 wherein the discharge end of said nozzle is positioned in the vicinity of the tip of said blade.

4. The drilling tool according to claim 1 wherein the conduit means is flexible.

5. The drilling tool according to claim 4 wherein the density of the conduit means is such that the conduit will be neutrally buoyant in the fluid circulated therethrough to the shaft of the drilling tool.

6. The drilling tool according to claim 5 wherein the density of the rotary drilling tool is such that the tool will be neutrally buoyant in the fluid circulated therethrough.

7. The drilling tool according to claim 4 including means affixed to said shaft for guiding the direction of advance of said tool.

8. A rotary drilling tool for drilling a well bore in the earth comprising in combination:

a. a shaft;

b. a marine screw propeller affixed to said shaft in a manner such that rotation of said propeller generates forward thrust along the axis of said shaft;

c. boring means fixed to the forward end of said shaft, said boring means having external diameter at least as great as the diameter of said propeller means;

d. hydraulically powered motor means comprising a housing and means connected to said shaft, said shaft connected means adapted to rotate said shaft when said motor is actuated by the flow of fluid therethrough; and e. a twist resistant, flexible shaft conduit connected to said housing and adapted to conduct pressurized drilling fluid from the earth's surface to said motor said conduit comprising the sole means connected to said housing.

9. A rotary drilling tool for drilling a well bore in the earth comprising in combination:

a. a hollow shaft;

b. a marine screw propeller affixed to said shaft in a manner such that rotation of said propeller generates forward thrust along the axis of said shaft;

c. boring means fixed to the forward end of said shaft, said boring means having an external diameter at least as great as the diameter of said propeller means;

d. a twist resistant flexible conduit adapted to conduct pressurized drilling fluid to said hollow shaft;

(e) means connecting the rear end of said hollow shaft and said conduit to permit relative rotation therebetween;

(f) at least one fluid passage extending through said boring means for the discharge of drilling fluid conducted through said hollow shaft from the forward face of said boring means; and (g) means connected to said shaft and actuated by the flow of drilling fluid therethrough to cause rotation of said shaft.

10. A rotary drilling tool for drilling a well bore in the earth comprising in combination:

(a) a hollow shaft;

(b) a marine screw propeller affixed to said shaft in a manner such that rotation of said propeller generates forward thrust along the axis of said shaft;

(c) boring means fixed to the forward end of said shaft said boring means having an external diameter at least as great as the diameter of said propeller means;

(d) hydraulically powered means for rotating said shaft;

(e) a hollow conduit for conducting drilling fluid from the earth's surface to said hollow shaft and to said means for rotating said shaft;

(f) means connecting said shaft and said conduit for permitting relative rotation therebetween; and (g) at least one fluid passage extending through said boring means for discharging drilling fluid conducted through said hollow shaft from the forward face of said boring means.

11. A rotary drilling tool for drilling a well bore in the earth comprising in combination:

a. boring means mounted at the end of a hollow shaft;

b. at least one fluid passage extending through said boring means for discharge of fluid conducted through said hollow shaft from the forward face of said boring means;

c. a flexible conduit adapted to conduct drilling fluid and energy;

d. means connecting the forward end of said flexible conduit to said shaft carrying said boring means for conducting drilling fluid to said shaft while permitting relative rotation between said shaft and said conduit;

(e) a marine screw propeller fixed to a shaft in a manner such that rotation of said propeller generates forward thrust along the axis of said shaft;

(f) means for converting the energy carried by said conduit to a force causing rotation of the shaft carrying said propeller; and (g) means for transmitting the forward thrust generated by the rotation of said propeller from said shaft carrying said propeller to said conduit and said boring means.

12. The drilling tool of claim 10 in which means is carried by the conduit adjacent the end connected to said shaft for orienting the inclination of said shaft relative to the axis of said well bore surrounding said shaft to control the direction of advance of said boring means.

13. The drilling tool of claim 12 in which the means for orienting the inclination of said shaft is a mass affixed to said conduit.

14. The drilling tool of claim 12 in which the means carried adjacent the end of said conduit are at least two centralizing means, the forward one of which tends to hold the conduit in the center of said well bore and the rearward one of which tends to hold said conduit in a position displaced from the center of said well bore in a direction opposite the desired direction of inclination of the forward end of said shaft.

* * * * *